United States Patent [19]

Bongianni

[11] Patent Number: 4,581,291

[45] Date of Patent: Apr. 8, 1986

[54] MICROMINIATURE COAXIAL CABLE AND METHODS MANUFACTURE

[76] Inventor: Wayne L. Bongianni, 408 Colleen Ct., Los Alamos, N. Mex. 87544

[21] Appl. No.: 566,759

[22] Filed: Dec. 29, 1983

[51] Int. Cl.[4] ..... H01B 7/00

[52] U.S. Cl. ..... 428/381; 428/383; 428/384; 428/389; 427/118; 427/119; 427/40; 427/41; 427/250; 427/251; 427/404; 427/409; 427/421; 174/102 R; 174/102 SP

[58] Field of Search ..... 174/102 R, 102 SP; 333/238, 243, 246; 427/118, 119, 41, 40, 250, 251, 404, 409, 421; 428/381, 383, 384, 389

[56] References Cited

U.S. PATENT DOCUMENTS

| | | | |
|---|---|---|---|
| 2,812,501 | 11/1957 | Sommers | 333/238 |
| 2,926,317 | 2/1960 | Blitz | 333/238 |
| 3,077,569 | 2/1963 | Ikrath | 174/28 |
| 3,408,453 | 10/1968 | Shelton | 427/118 |
| 3,573,976 | 4/1971 | Duane | 427/119 |
| 3,772,455 | 11/1973 | Nicodemus et al. | 427/119 |
| 3,990,024 | 11/1976 | Hou | 333/243 |

*Primary Examiner*—Richard Bueker
*Attorney, Agent, or Firm*—Fitch, Even, Tabin & Flannery

[57] ABSTRACT

A coaxial cable is provided having a ribbon inner conductor surrounded by a dielectric and a circumferential conductor. The coaxial cable may be microminiature comprising a very thin ribbon strip conductor from between 5 to 15 μm thick and from 150 to 200 μm wide, having a surrounding foamed dielectric or parylene applied thereon by a vapor plasma process and an outer conductor of an adhering high conductivity metal vacuum deposited on the dielectric. Alternately the foam dielectric embodiment may have a contiguous parylene coating applied adjacent the inner conductor or the outer conductor or both. Also, the cable may be fabricated by forming a thin ribbon of strip conductive material into an inner conductor, applying thereabout a dielectric by spraying on a solution of polystyrene and polyethylene and then vacuum depositing and adhering high conductivity metal about the dielectric. The cable strength may be increased by adding glass microfilament fibers or glass microballoons to the solution of polystyrene and polyethylene. Further, the outer conductive layer may be applied by electroless deposition in an aqueous solution rather than by vacuum deposition. A thin coating of parylene is preferably applied to the outer conductor to prevent its oxidation and inhibit mechanical abrasion.

16 Claims, 2 Drawing Figures

STRIP CENTERED
COAXIAL CONDUCTOR

NORMAL COAX

STRIP CENTERED
COAXIAL CONDUCTOR

MICROMINIATURE COAXIAL CABLE AND METHODS MANUFACTURE

This invention is the result of a contract with the Department of Energy (Contract No. W-7405-ENG-36).

BACKGROUND OF THE INVENTION

The field of the invention relates to coaxial cables and more particularly to microminiature coaxial cables and method for their manufacture.

When the frequency of an electromagnetic wave increases to the point where its wavelength becomes small compared to the length of the conductor carrying it the wave tends to radiate into free space. This radiation is prevented when the conductor is surrounded by a grounded electrical conductor as in the case of coaxial cable. The smallest commerically available cable to date is about 80 mils in diameter, which is large when compared to the environment in which it might be used. Areas which could utilize coaxial cable of a few mils in diameter are integrated circuit technology, shock wave measurements, biological uses, lighweight coaxial cables for satellites, spacecraft plasma probes for laser welders, and "invisible" cabling for home and institutional video products such as cable TV. In integrated circuit technology, a need to communicate between many high frequency chips can be favorably accomplished utilizing microminiature coaxial cable. In shock wave measurements, experiments on shock and detonation waves require the use of coaxial cable for velocity measurement. The coaxial cable must be very small in order to minimize its effect on the wave front. Since it is desirable to make the explosive experiment as small as possible, very small coaxial cable is desirable. In biological uses, microwaves in the human body and animals are becoming a regular research area. In particular, the local heating of tissue by microwave has been used in the treatment of cancer. To minimize the trauma of the conductor to the surrounding tissue, very small coaxial cable is desirable.

In order to be practical, a microminiature coaxial cable must also have low-loss. The largest loss of energy is a resistive loss of the internal conductor. As frequency goes up the skin effect confines the radio frequency signal to the surface of the center conductor, which in a normal coaxial cable center conductor is the circumference of a thin wire. If one merely scaled down normal coaxial geometry, the circumference of the center conductor would soon become too small to carry the signal without unreasonable loss. This problem is overcome by the preferred embodiment of the invention.

One object of the invention is to inexpensively manufacture microminiature coaxial cable.

Another object of the invention is to provide coaxial cable a few mils in diameter or less.

One advantage of the instant invention is that the microminiature coaxial cable thereof can be utilized in many applications requiring coaxial cable of very small diameter.

Another advantage of the instant invention is that low-loss is achieved in a microminiature coaxial cable.

Another advantage is that normal circular coaxial cable can be replaced with smaller cable having the same loss, hence having a weight and materials cost reduction over normal coax of about 40%.

SUMMARY OF THE INVENTION

In accordance with the present invention there is provided a microminiature coaxial cable having a ribbon inner conductor surrounded by a dielectric and a circumferential conductor. A method of constructing such a microminiature coaxial cable may comprise preparing a strip conductor into a very thin ribbon from between 5 to 15 μm thick and from 150 to 200 μm wide, applying a dielectric about the strip conductor comprising a low-loss platic of parylene by a vapor plasma process, and finally applying an outer conductor by vacuum deposition of an adhering high conductivity metal. Alternately, a foam dielectric may be used. Additionally, a thin parylene coating may be applied contiguous to the foam dielectric either adjacent the inner conductor or the outer conductor or both.

Another method for manufacturing a microminiature coaxial cable in accordance with the invention comprises forming a thin ribbon of strip conductive material into an inner conductor, applying a dielectic about the inner conductor by spraying a solution of polystyrene and polyethylene about the center conductor and the vacuum depositing and adhering high conductivity metal about the dielectric. The strength of the cable may be increased by adding microfilm and fibers or glass microfilament fibers or glass microballoons to the solution of polystyrene and polyethylene. In addition, the outer conductive layer may be applied by electroless deposition of the conductor in an aqueous solution rather than by vacuum deposition. A thin coating of parylene is preferably applied to the outside conductor to prevent its oxidation and inhibit mechanical abrasion.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION OF THE INVENTION

Figure 1:
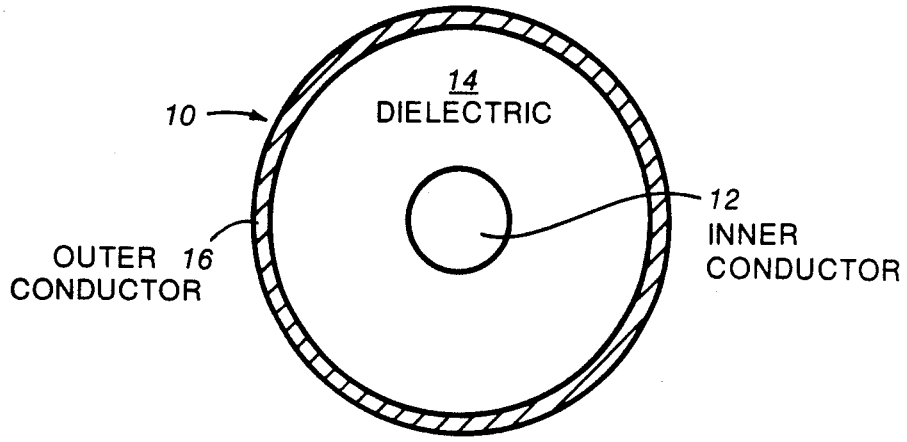
PRIOR ART Fig. 1
FIG. 1 comprises a cross section of typical prior art coaxial cable.
Figure 2:
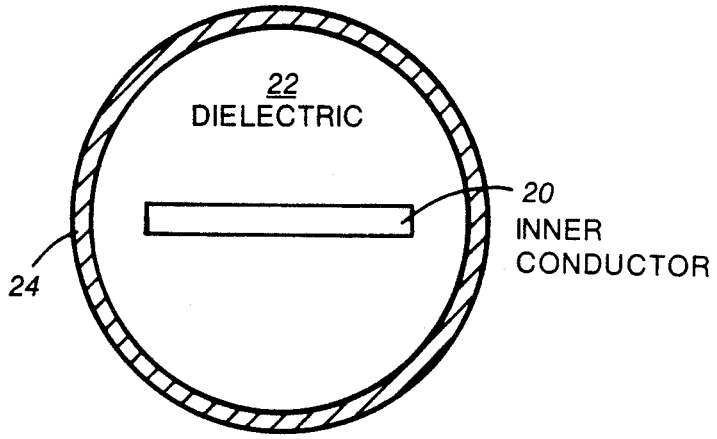
FIG. 2 is a cross sectional showing of a preferred embodiment of the invention.

Reference is first made to FIG. 1 which shows a representation of a typical prior art coaxial cable 10 having circular inner conductor 12 surrounded by dielectric material 14 and finally surrounded by a circular outer conductor 16. The circular cross section of the inner conductor of the normal or typical coaxial cable minimizes the surface area to volume ratio of the center conductor. This maximizes the resistive loss of the center conductor. By replacing the circular cross section with a very thin strip as in practicing the invention as seen in the representation of FIG. 2, the surface area to volume ratio is maximized with a consequent improvement in the reduction of loss. As seen in FIG. 2, a central ribbon inner conductor 20 is surrounded by a dielectric 22 and finally surrounded by a circular cross sectional outer conductor 24.

A possible concern of the geometry of the preferred embodiment of the invention is that the lack of symmetry might induce a maximum current at the edges of the ribbon center conductor thereby increasing loss and undoing the hope for low-loss. An investigation showed that there was very lows-loss indeed in utilizing the cable of the invention. In addition it was found that in impedance values of interest; that is 50 ohms and 75 ohms could be as easily obtained as in a normal coaxial cable.

The methods of manufacture are as follows:

1. The center conductor is made from normally drawn copper (or other ductile metal) wire of circular cross section. In this way very small wire is obtaiend, i.e., 1 mil or less. The wire is then rolled between two rollers, with multiple passes and the roller-to-roller distance constantly shrunk, a very thin ribbon is obtained. Nominally a thickness of 10 μm with a width of 150 μm can be obtained in this manner from a 1.5 mil wire.

2. The dielectric has been successfully applied by two methods. The first method consists of spraying a solution of polystyrene dissolved in toluene onto a rotating, moving mandrel. The polystyrene normally dries to a ridged, brittle hardness, which can be broken when the coax is flexed. This problem has been solved by adding polyethylene to the solution, making the coax more flexible. Alternately, glass microfilament fibers or glass microballoons may be added during the spraying process to increase the strength.

The second process consists of applying parylene by the vapor plasma process (VPP). The parylene has been found to strongly adhere to the conductor, vary in cross section from conformal to circular to the thickness needed, and is exceptionally strong (in fact, supplying all of the coax strength).

In addition, it has been found that the parylene centers the inner conductor and deposits uniformly to better than 1%. This is many times better than normal coax which uses an extrusion process. Wear in the extrusion die and instability in the extrusion flow gives rise to variations of 5% to 10% in small cable. This improvement further reduces the loss in this cable over normal coax.

In all cases, low-loss plastics are used for the dielectrics to minimize the coax-dielectric loss.

3. The outer conductor is then applied in two ways. The first is the vacuum deposition of aluminum (or other adhering high conductivity metal) on a rotating mandrel. Or alternately, the outer conductor can be applied by the electroless deposition of copper (or other conductors) in an aqueous solution.

4. Although not necessary to its operation, a thin coating of parylene (2 μm thick) applied to the outside as a final operation holds the copper outer conductor in place and prevents oxidation and mechanical abrasion.

5. Because the strip conductor works so well, any loss due to the dielectric becomes appreciable. This is minimized by foaming the dielectric. Four methods for accomplishing this are: (1) applying air filled microballoons during the spraying process, (2) first coating the inner conductor with a foaming agent and then applying the dielectric, (3) foaming the spray, i.e., adding air bubbles to this fluid during the spraying process, and (4) applying a current to the center conductor thus heating the solvent and/or dielectric to a point where bubbles are formed. In all cases, a gas filled dielectric results, and since gases are much lower loss dielectrics than any solid, a low-loss dielectric layer is formed.

6. Finally, a high dielectric material may be incorporated (to reduce the breakdown voltage or increase the delay per unit length) during the spray process, or by coating the center conductor in vacuum. An example of this is the coating of the inner conductor with titanium dioxide powder or film evaporation, which has a low dielectric loss and a high dielectric constant of $\epsilon=70$ (compared with polystyrene $\epsilon=2.5$).

Although not critical to its operability, a thin (on the order of 2 μm thick) coating of parylene may be applied to the external surface of the outer conductor to hold the outer conductor in place and prevent its oxidation and mechanical abrasion.

The foregoing description of the preferred embodiment(s) of the invention have been presented for purposes of illustration and description. It is not intended to be exhaustive or to limit the invention to the precise form disclosed, and obviously many modifications and variations are possible in light of the above teaching. The embodiment(s) were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of constructing microminiature coaxial cable comprising:

(a) preparing a strip conductor into a very thin ribbon from between 5 to 15 μm thick and from 150 to 200 μm wide;

(b) applying a foamed dielectric comprising low-loss plastic about the strip conductor;

(c) applying parylene by a vapor plasma process; and (d) applying an outer conductor by vacuum deposition of an adhering high conductivity metal.

2. The method of claim 1 wherein the strip conductor is made of a drawn copper wire of circular cross section by rolling the wire between rollers until a very thin ribbon is obtained.

3. The invention of claim 1 wherein aluminum is the adhering high conductivity metal.

4. The invention of claim 1 wherein during vapor deposition the cable is rotated.

5. The invention of claim 1 further comprising applying a thin coating of parylene to the outside surface of the cable to hold the outer conductor in place and prevent oxidation and mechanical abrasion thereof.

6. A method for manufacturing a microminiature coaxial cable comprising:

(a) forming a thin ribbon of strip conductive material into an inner conductor;

(b) applying a dielectric about the inner conductor by spraying a solution of polystyrene and polyethylene about the center conductor; and (c) applying an adhering high conductivity metal about the dielectric.

7. The invention of claim 6 further comprising adding glass microfilament fibers or glass microballoons to the solution of polystyrene and polyethylene to increase the strength of the cable.

8. The invention of claim 6 wherein said high conductivity metal is applied by electroless deposition thereof in an aqueous solution.

9. The invention of claim 6 further comprising applying a thin coating of parylene to the outside of the outer conductor to prevent its oxidation and inhibit mechanical abrasion thereof.

10. A microminiature coaxial cable comprising:

a thin ribbon inner conductor;

a dielectric coaxial with and surrounding said thin inner conductor;

a thin outer conductor coaxial with and surrounding said dielectric; and a protective coating surrounding said outer conductor wherein said protective coating is a parylene protective coating.

11. A method of constructing coaxial cable comprising:

(a) preparing a strip conductor into a thin ribbon;

(b) applying a dielectric comprising low-loss plastic coaxially distributed about said thin ribbon;

(c) applying an outer conductor coaxial with and surrounding said dielectric; and (d) applying a thin coating of parylene to the outside surface of the cable to hold the outer conductor in place and prevent oxidation and mechanical abrasion thereof.

12. A method for manufacturing a coaxial cable comprising:

(a) forming a thin ribbon of strip conductive material into an inner conductor;

(b) applying a dielectric coaxially distributed about the inner conductor by spraying a solution of polystyrene and polyethylene about the inner conductor; and (c) depositing an adhering high conductivity metal about the dielectric such that said metal surrounds said dielectric.

13. The invention of claim 12 further comprising adding glass microfilament fibers or glass microballoons to the solution of polystyrene and polyethylene to increase the strength of the cable.

14. The invention of claim 12 wherein said high conductivity metal is applied by electroless deposition thereof in an aqueous solution.

15. The invention of claim 12 further comprising applying a thin coating of parylene to the outside of the outer conductor to prevent its oxidation and inhibit mechanical abrasion thereof.

16. A coaxial cable comprising:

a thin ribbon inner conductor;

a dielectric surrounding said thin inner conductor;

a thin outer conductor surrounding said dielectric; and a protective coating surrounding said outer conductor wherein said protective coating is a parylene protective coating.

* * * * *